United States Patent [19]

Raab

[11] 4,082,091

[45] Apr. 4, 1978

[54] HYDRO-AIR FITTING

[75] Inventor: Alfred Raab, Willowdale, Canada

[73] Assignee: Jacuzzi Bros., Inc.

[21] Appl. No.: 753,450

[22] Filed: Dec. 22, 1976

[51] Int. Cl.[2] ..... A61H 9/00

[52] U.S. Cl. ..... 128/66; 4/180

[58] Field of Search ..... 128/66, 24.1; 4/178, 4/180

[56] References Cited

U.S. PATENT DOCUMENTS

| | | | |
|---|---|---|---|
| 3,540,438 | 11/1970 | Jacuzzi | 128/66 |
| 3,905,358 | 9/1975 | Jacuzzi | 128/66 |

*Primary Examiner*—Lawrence W. Trapp

*Attorney, Agent, or Firm*—Hill, Gross, Simpson, Van Santen, Steadman, Chiara & Simpson

[57] ABSTRACT

A hydrotherapeutic aerator assembly for mixing air as fine bubbles into the center of a stream of pressurized water has a swivelable ball carrying a nozzle in which mixing of air and water occurs before ejection of the stream into a pool or bath. A housing containing the ball and nozzle has half of a ball socket formed therein. A one-piece ball seal and retaining member attachable to the housing forms a second half of the ball socket. The nozzle is adjustable axially within the ball on cooperating threads and is made non-removable from the ball by a radially-extending O-ring snapped into a channel in a rearward part of the nozzle. A circumferential abutment surface in the ball prevents withdrawal of the nozzle beyond a selected position.

6 Claims, 3 Drawing Figures

Fig. 1
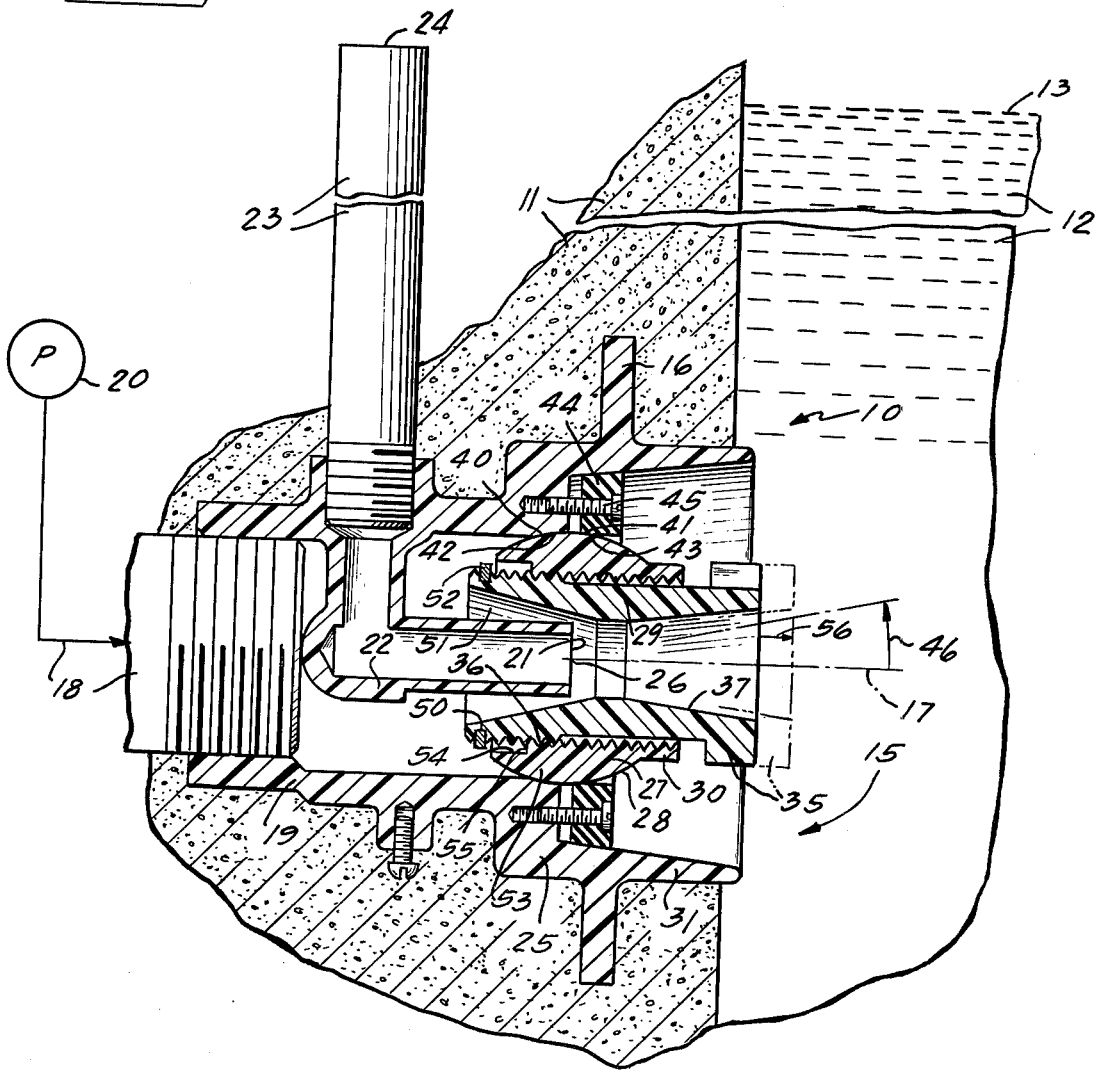
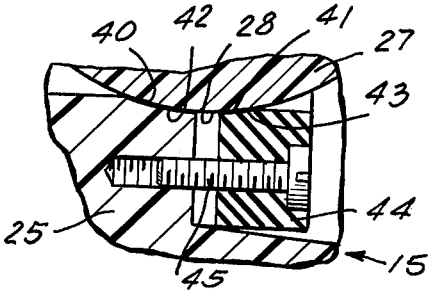
Fig. 2
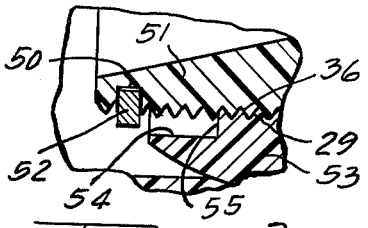
Fig. 3

HYDRO-AIR FITTING

BACKGROUND OF THE INVENTION

1. Field of the Invention

The present invention relates to improvements in fitting used to combine air with a pressurized water stream in swimming pools and baths for aeration, hydrotherapy, hydromassage, and similar purposes.

2. The Prior Art

The Virgil Jacuzzi U.S. Pat. No. 3,905,358, assigned to the assignee of the present invention, discloses a hydro-air fitting in which a ball is mounted in two sealing members and a retaining member each separately fitted with the housing, and wherein the nozzle is either removable from within the ball or is retained therein by a separate set screw passed through the ball. U.S. Pat. No. 3,540,438 to Roy Jacuzzi discloses a hydro-air jet assembly wherein a rear portion of the housing is formed as a socket against which a swivelable ball is retained by a two-piece seal and retaining member separately attached to the housing. A pair of set screws spaced axially apart in a side wall of the ball forms stop members against respective front and rear ridges forming a seat for a sealing member between water and air passages of the assembly.

SUMMARY OF THE INVENTION

In a hydro-air fitting of the general configuration of Virgil Jacuzzi U.S. Pat. No. 3,905,358, a rear seat and sealing member for the swivelable ball is replaced by a spherical configuration formed directly in the hollow housing member, and the two-piece front seat and sealing members are combined into a one-piece seal and retaining member for more economical production and with less chance of misassembly. Further, a flexible ring or split ring is fitted in a channel about a rearward portion of the nozzle to abut against a circumferential surface formed on the ball to provide positive protection against withdrawal of the nozzle from the ball.

THE DRAWINGS

FIG. 1 is a longitudinal, side sectional view through the improved hydro-air fitting of the present invention.

FIGS. 2 and 3 are enlarged side sectional views of details of FIG. 1.

THE PREFERRED EMBODIMENTS

An improved hydro-air fitting 10 is shown in FIG. 1 embedded in a wall 11 of a pool of water 12 having a maximum level 13. While the wall 11 is shown as a concrete structure and a housing 15 of the fitting 10 is specifically adapted for mounting therein as by a radially extending flange 16, suitable modification of the housing 15 can adapt the fitting 10 for use in thin-walled pool enclosures, as known to those skilled in the art.

The housing 15 is a hollow, molded article made in one piece of a plastic or thermoplastic material and generally defining a central axis 17. An interior of the housing 15 is charged with water through a conduit 18 provided on the axis 17 at a rearward portion 19 of the housing, the water conduit 18 being supplied with pressurized water from a source such as a pump 20. A supply of air is also provided to the interior of the housing 15 along the axis 17 at a radially extending air port 21 formed in a tubular member 22 aligned with the axis 17 and communicating to an air conduit 23 extending to an air intake opening 24 arranged gravitationally above the maximum fluid level 13 of the water body 12.

In a central portion 25 of the housing 15, centered about an intersection 26 between the axis 17 and the fixed air port 21 is a ball 27 having a spherical outer surface 28. The ball 27 has a cylindrical passage formed therethrough by a threaded cylindrical bore 29. A collar portion 30 is formed integrally on a forward part of the ball 27 to extend into a forward portion 31 of the housing 15.

A nozzle member 25 having a cylindrical, threaded outer surface 36 is cooperatively received within the threaded bore 29 of the ball 27. The cooperative threads 29, 36 permit axial adjustment of the nozzle 35 with respect to the ball 27, the housing 15, and the tubular air member 22. An interior flow passage 37 of the nozzle 35 defines, respectively, in a downstream direction toward the forward end 31 of the housing 15, relatively converging and diverging sections in accordance with the disclosure of U.S. Pat. No. 3,905,358.

In accordance with the principles of the present invention, the ball 27 is received and retained in the housing 15 by first and second spherical socket portions 40, 41 which engage against respective rearward and forward spherical surfaces 42, 43, respectively of the ball 27. The first, rearward ball socket surface 40 is molded or otherwise formed directly in the center portion 25 of the housing 15. The second, forward ball socket portion 41 is carried on an annular, one-piece sealing and retaining member 44 fitted into the housing 15 about the ball 27 and secured to the housing 15 by attachment means such as a pair or more of screws 45. The sealing and retaining member 44 is radially sized to fit between the ball 27 and the conical wall of the housing 15 and especially to resist rotation of the ball 27 about the axis 17 as the nozzle 35 is screwed along the threaded 29, 36. The member 44 does permit easy swiveling of the ball 27 about the point 26 through an angle 46 in any direction about the axis 17, until the collar 30 abuts against member 44. The member 44 is preferably formed of a thermoplastic material such as that employed to mold the housing 15. The plastic material permits elimination of separate seals heretofore provided in these devices.

Further in accordance with the principles of the present invention, the nozzle member 35 is made nonremovable from the ball 27 and the hydro-air fitting 10 by forming a recessed channel or groove 50 in a rearward portion 51 of the nozzle 35. The recess, groove, or channel 50 has inner, rearward, and forward walls as shown in detail in FIG. 3. It is preferable to cut the threads 36 to the end of the nozzle 35 and then to make the recess 50. A flexible ring 52, such as a split plastic or an elastomer O-ring, is fitted over the rearward portion 51 of the nozzle 35 and into the channel 50 where it is retained by the forward and rearward walls in a selected radial and axial position. A radially outward portion of the ring 52 extends radially outwardly of the threads 36 on the nozzle 35.

A rearward end 53 of the ball 27 is formed with a circumferentially recessed portion 54 to avoid interfering with the ring 52 on the nozzle 35. A forward termination or abutment surface 55 of the recess 54 together with the ring 52 allows the nozzle 35 to be moved axially forwardly through a distance 56 as shown in FIG. 1, but no farther. Rearward movement of the nozzle 35 with respect to the ball 27 and housing 15 is unaffected by the ring 52, so that the internal passage 37 of the nozzle 35 may interact with the walls of the tubular air passage 22 to control and reduce the flow of water passing outwardly from the conduit 18 into the body of fluid 12.

In operation, the hydro-air fitting 10 manufactured in accordance with the present invention is assembled from a housing 15, a ball 27, a nozzle 35, a sealing and retaining member 44, a pair of screws 45, and a flexible ring 52, plus conduits 18 and 23 as necessary. First, the nozzle 35 is screwed through the ball 27 in a rearward direction, from the frontward, collar portion 30 thereof and past the rearward portion 53 of the ball 27. Once the rear end 51 of the nozzle 35 emerges from the rearward end of the ball 27, the flexible ring 52 may be distorted or expanded and snapped into the channel 50 where it is retained by the respective walls thereof. The nozzle 35 may not thereafter be removed from the ball 27 without first removing the ring 52. Next, the ball 27 with the nozzle 35 therein is inserted into the housing 15 and against the first, rearward spherical socket portion 40 about the axis 17 of the housing. The annular seal and retaining member 44 is dropped into the forward portion 31 of the housing 15 about the ball 27. Apertures in the member 44 are aligned with corresponding apertures formed in the center portion 25 of the housing 15 and the attachment means or screws 45 are inserted therethrough and tightened. The second, forward spherical socket surface 41 engages against the forward spherical surface 43 of the ball 27, snugly engaging same to retain the ball 27 in the housing 15 and to seal against flow of water about the ball 27.

In operation, this arrangement allows the nozzle 35 to be swiveled about the center point 26 of the ball 27 in the socket provided and to move axially to control water and air flow through the interior passage 37. Depending upon the configuration of the forward end of the tubular air passage 22 and the converging portion of the passage 37, as disclosed in U.S. Pat. No. 3,905,358, water flow may be completely shut off by screwing the nozzle 35 to its rearwardmost position.

Although various minor modifications may be suggested by those versed in the art, it should be understood that I wish to embody within the scope of the patent warranted hereon all such modifications as reasonably and properly come within the scope of my contribution to the art.

I claim as my invention:

1. In a hydrotherapy nozzle assembly for controlling and directing a flow of aerated water, the assembly comprising a housing forming an axial flow passage for a stream of pressurized water, a tubular air means forming a radially extending air port at the axis of the passage, an externally threaded nozzle member extending downstream of said air port, an internally threaded ball member mounting said nozzle member for movement along and for universal swiveling movement about said axis, and the ball member having respective rearward and forward spherical surfaces, the improvement of a ball socket means and nozzle retention means comprising:

a groove portion of radially reduced outside diameter formed on a rearward end of said nozzle member and having rearward and forward axial walls;

an O-ring member receiveable in said groove portion for retention thereby and extending radially outwardly of the threads on the nozzle member;

a circumferentially extending abutment surface formed in said ball member axially adjacent said internal threads thereof and spaced radially to engage a forward side of said O-ring member;

a spherical socket portion formed in said housing to receive said rearward surface of said ball member; and a one-piece sealing and retention member received circumferentially about said forward spherical surface of the ball member and secured removably in the housing to retain the ball member swivelably in a selected axial position.

2. In a hydrotherapy nozzle assembly comprising a hollow housing having a pressurized water conduit extending into said housing and along an axis therethrough, a nozzle receiving and passing a flow of water from said water conduit and air mixed therewith from a second conduit, a ball carrying said nozzle therein for universal pivoting movement with respect to the housing and having rearward and forward spherical surface portions thereon, the improvement of means for retaining said ball in the housing and said nozzle in the ball, comprising:

a spherical socket surface opening toward a forward portion of said assembly and formed integrally in said housing to swivelably engage said rearward spherical portion of the ball;

said means for retaining the ball in the housing comprising a one-piece seal member having a spherical socket surface opening toward a rearward portion of the housing and sealingly and slidingly engaging said forward spherical portion of said ball and having attachment means passing therethrough to engage the housing;

a radially and circumferentially extending stop member carried on a rearward portion of said nozzle; and an axially facing, circumferentially extending abutment surface formed integrally on a rearward portion of the ball in a position engageable with said stop member when said nozzle is moved axially to a forwardmost position with respect to said ball.

3. In a hydrotherapy nozzle assembly, the improvement of claim 2, wherein the stop member is an O-ring and said rearward portion of said nozzle is formed with a circumferential channel receiving and restraining the O-ring from radial and axial movement.

4. A hydrotherapy nozzle assembly comprising:

a hollow housing molded in one piece of a plastic material and having an axis and axial air and water inlets thereinto and a rearward portion of a ball socket formed therein about said axis;

a ball having an axial passage formed therein and received in said rearward ball socket for universal swiveling movement about said axis;

a one-piece circumferential seal member received in said housing and having a forward spherical socket portion formed thereon to engage sealingly against said ball;

attachment means for securing said seal member to said housing;

a nozzle received through said axial passage of said ball, said ball and said nozzle having cooperating threaded portions formed thereon to permit relative axial movement of said nozzle with respect to said ball and housing;

a radially depressed, axially restricted channel portion formed in a rearward portion of said nozzle;

a circumferentially extending stop member received in said channel and extending radially outwardly of said channel; and a circumferential, axially facing abutment surface formed on said ball adjoining a rearward portion of said threaded portion thereof, whereby the ball is readily retained swivelably in the housing and engagement between the stop member on the nozzle and the abutment surface on the ball prevents withdrawal of the nozzle from the ball beyond a selected forwardmost position thereof.

5. A hydrotherapy nozzle assembly as defined in claim 4, wherein said seal member is a thermoplastic material.

6. A hydrotherapy nozzle assembly as defined in claim 4, wherein the stop member is a flexible, substantially radially split ring.

* * * * *